US010344524B2

(12) United States Patent
Myers

(10) Patent No.: US 10,344,524 B2
(45) Date of Patent: Jul. 9, 2019

(54) DOOR FRAME

(71) Applicant: Cool-It, Cuba City, WI (US)

(72) Inventor: Scott J. Myers, Dubuque, IA (US)

(73) Assignee: Cool-It., Cuba City, WI (US)

( * ) Notice: Subject to any disclaimer, the term of this patent is extended or adjusted under 35 U.S.C. 154(b) by 0 days.

(21) Appl. No.: 15/901,563

(22) Filed: Feb. 21, 2018

(65) Prior Publication Data

US 2018/0252019 A1 Sep. 6, 2018

Related U.S. Application Data

(60) Provisional application No. 62/461,518, filed on Feb. 21, 2017.

(51) Int. Cl.

| | |
|---|---|
| ***E06B 1/12*** | (2006.01) |
| ***E06B 1/26*** | (2006.01) |
| ***E06B 1/34*** | (2006.01) |
| ***E06B 1/30*** | (2006.01) |
| ***E06B 1/60*** | (2006.01) |

(52) U.S. Cl.

CPC ..... *E06B 1/12* (2013.01); *E06B 1/26* (2013.01); *E06B 1/30* (2013.01); *E06B 1/34* (2013.01); *E06B 1/6023* (2013.01)

(58) Field of Classification Search

CPC ..... E06B 1/12; E06B 1/34; E06B 1/26

See application file for complete search history.

(56) References Cited

U.S. PATENT DOCUMENTS

| | | | | |
|---|---|---|---|---|
| 2007/0204534 | A1* | 9/2007 | Lin | E06B 1/04 52/204.1 |
| 2008/0222979 | A1* | 9/2008 | Rissmiller | E06B 1/60 52/213 |
| 2009/0064609 | A1* | 3/2009 | Ouyang | E04F 19/0495 52/211 |
| 2009/0077911 | A1* | 3/2009 | Dove | E06B 1/12 52/213 |
| 2009/0193728 | A1* | 8/2009 | Butler | E06B 1/34 52/213 |
| 2009/0211183 | A1* | 8/2009 | Kerscher | E06B 1/32 52/204.1 |
| 2009/0211184 | A1* | 8/2009 | Kerscher | E06B 1/32 52/204.1 |
| 2011/0107695 | A1* | 5/2011 | Boldt | E06B 1/34 52/211 |
| 2011/0179730 | A1* | 7/2011 | Kolovich | E06B 1/12 52/204.2 |
| 2012/0031021 | A1* | 2/2012 | Charbonneau | E06B 1/08 52/204.1 |
| 2012/0031023 | A1* | 2/2012 | Scalzi | E06B 1/26 52/211 |
| 2012/0082878 | A1* | 4/2012 | Bergevin | E04F 19/0468 429/99 |
| 2012/0174514 | A1* | 7/2012 | Nolan | E06B 1/34 52/309.1 |
| 2013/0067835 | A1* | 3/2013 | Chou | E06B 1/34 52/173.1 |

(Continued)

*Primary Examiner* — Patrick J Maestri

(74) *Attorney, Agent, or Firm* — Casimir Jones, S.C.; David W. Staple

(57) ABSTRACT

Provided herein are door frames. In particular, door frames are provided that protect against impact, are water-proof, and protect against bacteria/mold infiltration.

15 Claims, 6 Drawing Sheets

(56) References Cited

U.S. PATENT DOCUMENTS

| | | | | |
|---|---|---|---|---|
| 2013/0219813 | A1* | 8/2013 | Gadoury | E06B 1/045 52/211 |
| 2013/0263536 | A1* | 10/2013 | Peck | E06B 1/34 52/211 |
| 2014/0102017 | A1* | 4/2014 | Booi | E06B 1/52 52/204.1 |
| 2014/0102018 | A1* | 4/2014 | Rochman | E06B 1/32 52/210 |
| 2014/0215939 | A1* | 8/2014 | Gosling | E06B 1/34 52/211 |
| 2015/0075109 | A1* | 3/2015 | Bergevin | E06B 1/08 52/656.2 |
| 2015/0113897 | A1* | 4/2015 | Behr | E06B 1/347 52/514 |
| 2015/0157146 | A1* | 6/2015 | Deloache | A47G 1/06 40/700 |
| 2015/0197979 | A1* | 7/2015 | Hawk | E06B 3/9645 52/656.5 |
| 2016/0076298 | A1* | 3/2016 | Header | E06B 1/34 52/204.5 |
| 2017/0241190 | A1* | 8/2017 | MacDonald | E06B 1/34 |
| 2017/0314320 | A1* | 11/2017 | Giuliani | E06B 1/52 |
| 2017/0356236 | A1* | 12/2017 | Rocca, Jr. | E06B 1/68 |
| 2018/0238100 | A1* | 8/2018 | Franklin | E06B 1/68 |
| 2018/0252019 | A1* | 9/2018 | Myers | E06B 1/12 |
| 2018/0258684 | A1* | 9/2018 | MacDonald | E06B 1/28 |
| 2018/0266167 | A1* | 9/2018 | Pinchot | E06B 1/34 |

* cited by examiner

HEADER

A)

B)

C)

DOOR FRAME

CROSS-REFERENCE TO RELATED APPLICATIONS

The present invention claims priority to U.S. Provisional Patent Application Ser. No. 62/461,518, filed Feb. 21, 2017, which is incorporated by reference in its entirety.

FIELD

Provided herein are door frames. In particular, door frames are provided that protect against impact, are waterproof, and protect against bacteria/mold infiltration.

BACKGROUND

Door frames are well known in the art. The conventional door frame has a shape that engages a wall and is positioned around the top and sides of an opening in the wall in which a door is installed. A hinge of the door is affixed to the door frame and a portion of the door frame is either recessed or set to protrude around a perimeter of the door frame in a fashion to prevent the door from passing through, thereby permitting the door to seal shut.

The conventional door frame suffers from a number of problems, they are susceptible to damage from collisions with users and equipment (e.g., especially in areas where machinery is driven), they do not facilitate easy cleaning, and they provide regions for mold/bacteria invasion and growth.

SUMMARY

Provided herein are door frames. In particular, door frames are provided that protect against impact, are waterproof, and protect against bacteria/mold infiltration.

In some embodiments, provided herein are door frame systems comprising: (a) a top C-channel configured for secure attachment to a header over a doorway opening, the doorway having an first face and a second face, wherein when securely attached to the header the top C-channel presents an first-face top flange along the top of the first face of the doorway and an second-face top flange along the top of the second face of the doorway; (b) a pair of vertical C-channels configured for secure attachment to the wall ends on either side of the doorway opening, wherein when securely attached to the wall ends each vertical C-channel present a first-face vertical flange along a side of the first face of the doorway an second-face vertical flange along a side of the second face of the doorway, wherein the vertical flanges all comprise a series of gaps and flange teeth; (c) a first-face door frame piece configured for covering the perimeter of the first face of the doorway, comprising a top frame element, a first-side frame element, and a second-side frame element, wherein: (i) the top frame element comprises: (A) a first end configured for positioning at the top-most point of the door frame, the first end comprising: (1) a terminal opening and key configured to receive a sealant to affix the top frame element to a wall above the doorway, and (2) a hanger element configured to engage the first-face top flange and secure the top frame element above the doorway; (B) a second end configured for positioning against the underside of the doorway header and extending beyond the midpoint of the underside of the header; and (ii) the first-side and second-side frame elements comprise: (A) first ends configured for positioning at the outer-most points of the first face of the door frame, the first ends comprising: (1) a terminal opening and key configured to receive a sealant to affix the side frame elements to walls on either side of the doorway, and (2) engagement elements comprising a series of gaps and frame teeth configured to engage the gaps and flange teeth of the first-face of the vertical C-channels and to secure the first-side and second-side frame elements of the first-face door frame piece against the first side and second side of the first face of the doorway; (B) second ends configured for positioning against the inside of the doorway sides and extending beyond the midpoints of the inside of the doorway sides; and (d) an second-face door frame piece configured for covering the perimeter of the second face of the doorway, comprising a top frame element, a first-side frame element, and a second-side frame element, wherein: (i) the top frame element comprises: (A) a first end configured for positioning at the top-most point of the door frame, the first end comprising: (1) a terminal opening and key configured to receive a sealant to affix the top frame element to a wall above the doorway, and (2) a hanger element configured to engage the second-face top flange and secure the top frame element above the doorway; (B) a second end configured for positioning against the underside of the doorway header, extending beyond the midpoint of the underside of the header, and covering the terminal portion of the second end of the top frame element of the first-face door frame piece; wherein the second end comprises a terminal opening and key configured to receive a sealant to affix the top frame element of the second-face door frame piece to the top frame element of the first-face door frame piece; and (ii) the first-side and second-side frame elements comprise: (A) first ends configured for positioning at the outer-most points of the second face of the door frame, the first ends comprising: (1) a terminal opening and key configured to receive a sealant to affix the side frame elements to walls on either side of the first face of the doorway, and (2) engagement elements comprising a series of gaps and frame teeth configured to engage the gaps and flange teeth of the second-face of the vertical C-channels and to secure the first-side and second-side frame elements of the second-face door frame piece against the first side and second side of the second face of the doorway; (B) second ends configured for positioning against the inside of the doorway sides, extending beyond the midpoints of the inside of the doorway sides, and covering the terminal portion of the second end of the side frame elements of the first-face door frame piece; wherein the second end comprises a terminal opening and key configured to receive a sealant to affix the side frame elements of the second-face door frame piece to the side frame elements of the first-face door frame piece.

In some embodiments, the C-channels comprise a metal material. In some embodiments, the C-channels comprise steal or aluminum. In some embodiments, the C-channels comprise 14-gauge steel.

In some embodiments, the door frame pieces comprise a polymer or polymer composite material. In some embodiments, the door frame pieces comprise ultra-high-molecular-weight polyethylene (UHMW) or fiber reinforced plastic (FRP)).

In some embodiments, a door frame system further comprises a wall panel comprising the doorway opening. In some embodiments, the wall panel comprises a polymer or polymer composite material. In some embodiments, the wall panel comprises ultra-high-molecular-weight polyethylene (UHMW) or fiber reinforced plastic (FRP)).

In some embodiments, a door frame system further comprises sealant to affix the frame elements to the wall and to each other. In some embodiments, the sealant produces a chemical weld between the frame elements and the wall and/or between the frame elements and each other. ISE the sealant comprises one or more compositions described in, for example, U.S. Ser. No. 14/609,117; herein incorporated by reference in its entirety.

In some embodiments, the C-channels further comprise indented portions for receiving one or more screws or bolts for securely attaching the C-channels to the doorway header and wall ends. In some embodiments, the system is configured to attached the door frame to the doorway opening without providing or creating holes through the door frame pieces. In some embodiments, the first ends of the frame elements taper toward the wall when secured in place.

In some embodiments, one or both of the side frame elements of the second-face door frame piece comprises a slot for attachment of a door hinge. In some embodiments, a door frame system further comprises a door hinge attached to the slot. In some embodiments, a door frame system further comprises a door attached to the door hinge.

In some embodiments, door systems described herein are provided with a pair angle rails (or other elongated structural elements) replacing one or more of the C-channels. In some embodiments, the pair of angle rails otherwise provides the same elements as a single C-channel.

In some embodiments, provided herein are the C-channels described herein and depicted in the figures.

In some embodiments, provided herein are the door frame pieces and/or elements described herein. In some embodiments, door frame pieces are pre-assembled (e.g., at a manufacturing facility) from door frame elements prior to installation (e.g., on work site). In some embodiments, door frame pieces are assembled from door frame elements during installation (e.g., on work site).

In some embodiments, provided herein is the use of the door frame systems described herein for the framing of a doorway (e.g., in a wall, in a wall panel, etc.).

In some embodiments, methods are provided for assembling the door frame systems described herein. For example, in some embodiments, C-channels are installed (e.g., with screws, with through bolt(s), etc.) on the wall ends and header of the doorway opening. In some embodiments, pre-assembled frame pieces are hung from the flanges of the C-channels. In some embodiments, sealant is applied within the openings and keys of the frame pieces to affix the frame pieces to the wall and to each other.

DEFINITIONS

Figure 1:
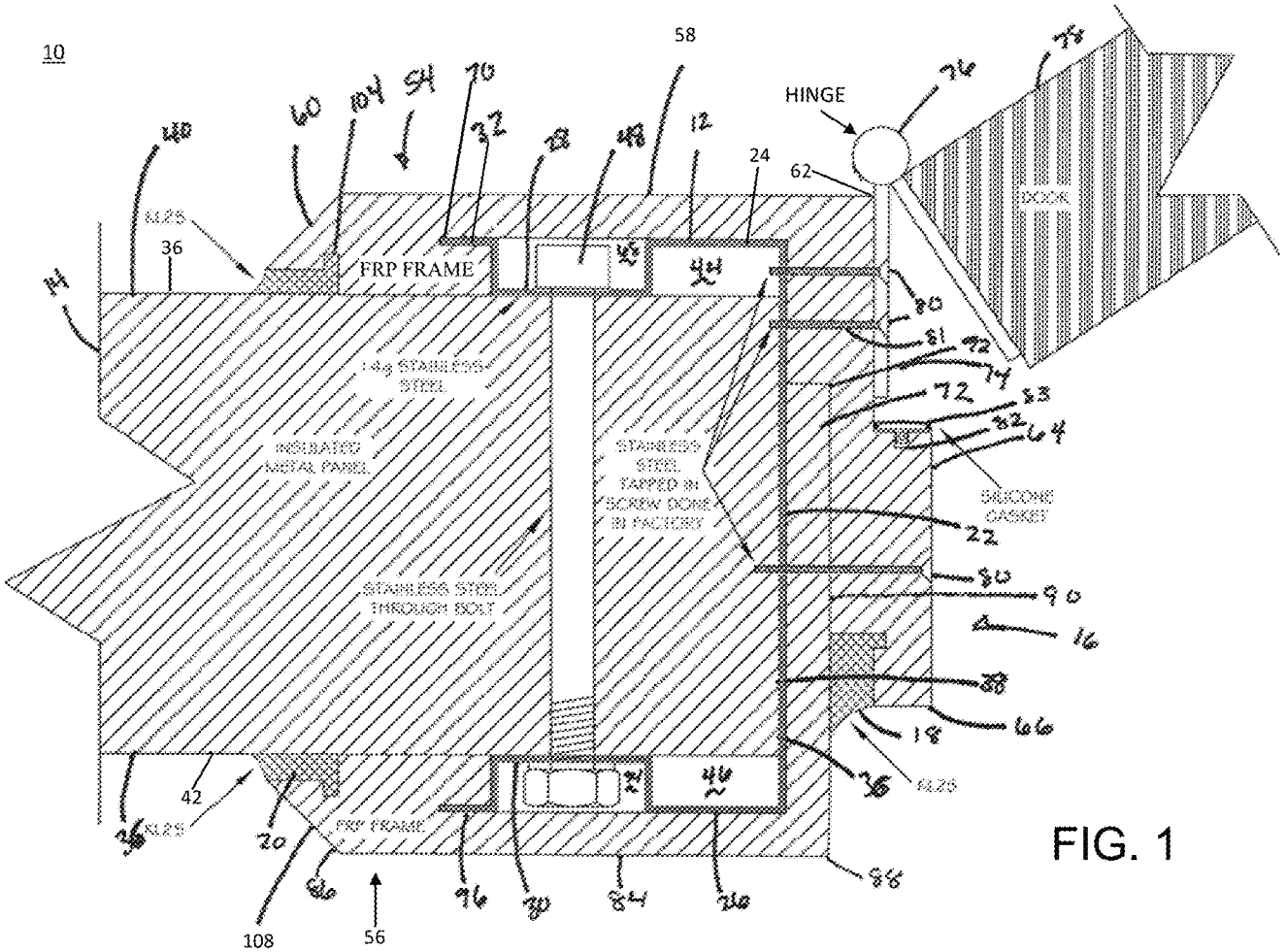
FIG. 1. Cross-sectional view of an exemplary door frame system installed on a vertical wall panel.
Figure 2:
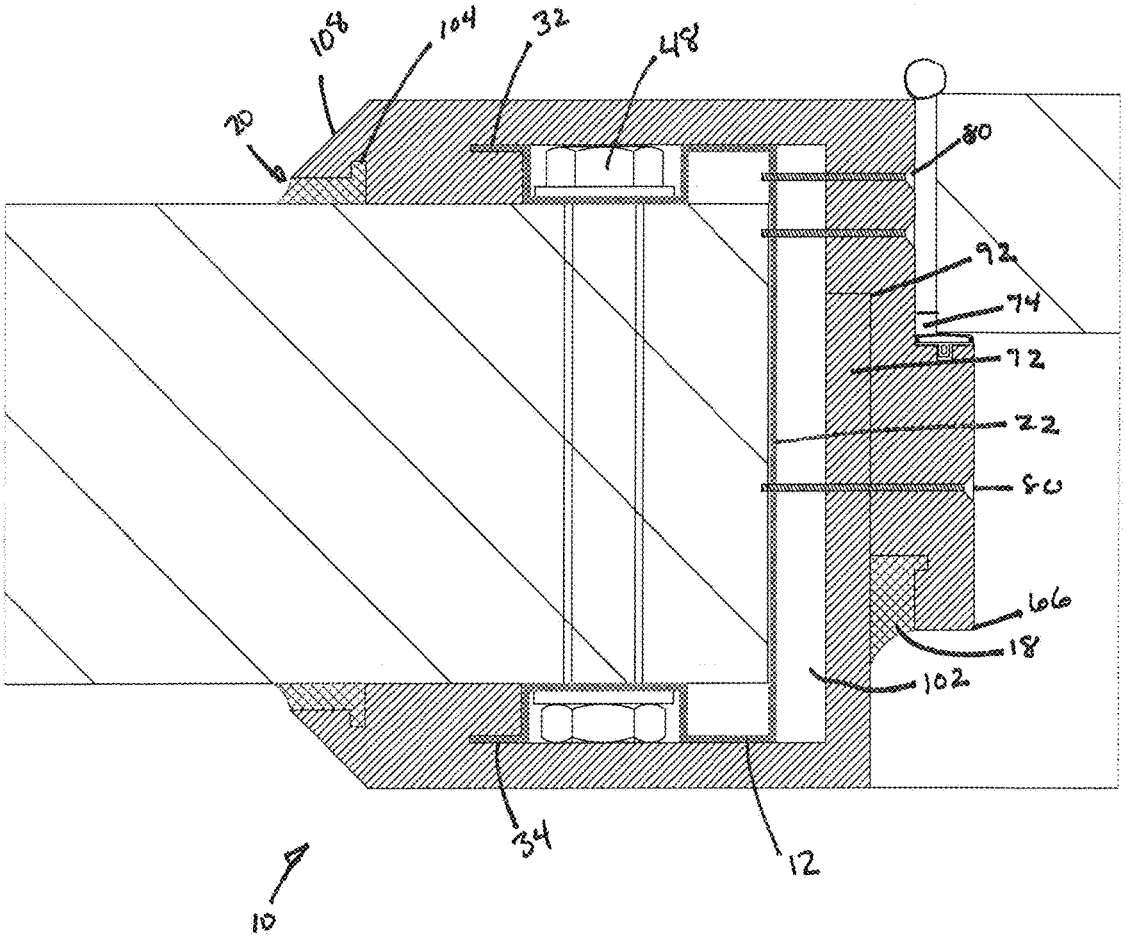
FIG. 2. Cross-sectional view of an exemplary door frame system installed on a door header.

Although any methods and materials similar or equivalent to those described herein can be used in the practice or testing of embodiments described herein, some preferred methods, compositions, devices, and materials are described herein. However, before the present materials and methods are described, it is to be understood that this invention is not limited to the particular molecules, compositions, methodologies or protocols herein described, as these may vary in accordance with routine experimentation and optimization. It is also to be understood that the terminology used in the description is for the purpose of describing the particular versions or embodiments only, and is not intended to limit the scope of the embodiments described herein.

Unless otherwise defined, all technical and scientific terms used herein have the same meaning as commonly understood by one of ordinary skill in the art to which this invention belongs. However, in case of conflict, the present specification, including definitions, will control. Accordingly, in the context of the embodiments described herein, the following definitions apply.

As used herein and in the appended claims, the singular forms "a", "an" and "the" include plural reference unless the context clearly dictates otherwise. Thus, for example, reference to "a door frame" is a reference to one or more door frames and equivalents thereof known to those skilled in the art, and so forth.

As used herein, the term "and/or" includes any and all combinations of listed items, including any of the listed items individually. For example, "A, B, and/or C" encompasses A, B, C, AB, AC, BC, and ABC, each of which is to be considered separately described by the statement "A, B, and/or C."

As used herein, the term "comprise" and linguistic variations thereof denote the presence of recited feature(s), element(s), method step(s), etc. without the exclusion of the presence of additional feature(s), element(s), method step(s), etc. Conversely, the term "consisting of" and linguistic variations thereof, denotes the presence of recited feature(s), element(s), method step(s), etc. and excludes any unrecited feature(s), element(s), method step(s), etc., except for ordinarily-associated impurities. The phrase "consisting essentially of" denotes the recited feature(s), element(s), method step(s), etc. and any additional feature(s), element(s), method step(s), etc. that do not materially affect the basic nature of the composition, system, or method. Many embodiments herein are described using open "comprising" language. Such embodiments encompass multiple closed "consisting of" and/or "consisting essentially of" embodiments, which may alternatively be claimed or described using such language.

As used herein, the term "substantially all," "substantially complete" and similar terms refer to greater than 99%; and the terms "substantially none," "substantially free of," and similar terms refer to less than 1%.

The terms "about" and "approximately" allows for a degree of variability in a value or range. As used herein, the term "about: refers to values within 10% of the recited value or range (e.g., about 50 is the equivalent of 45-55).

As used herein, the term "elongated structural element" refers to a structural product having a single long dimension (the longitudinal dimension) and a specific cross-sectional geometry along its length.

Figure 4:
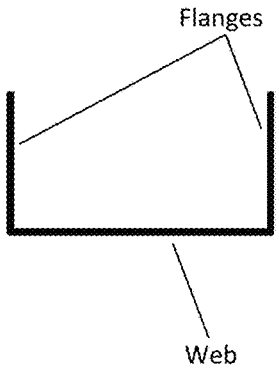
FIG. 4. Cross-sectional views of exemplary elongated structural elements: (A) C-channel, (B) I-channel, and (C) angle rail.
Figure 4:
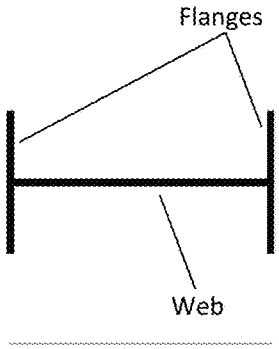
Figure 4:
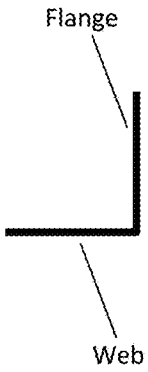
Figure 5:
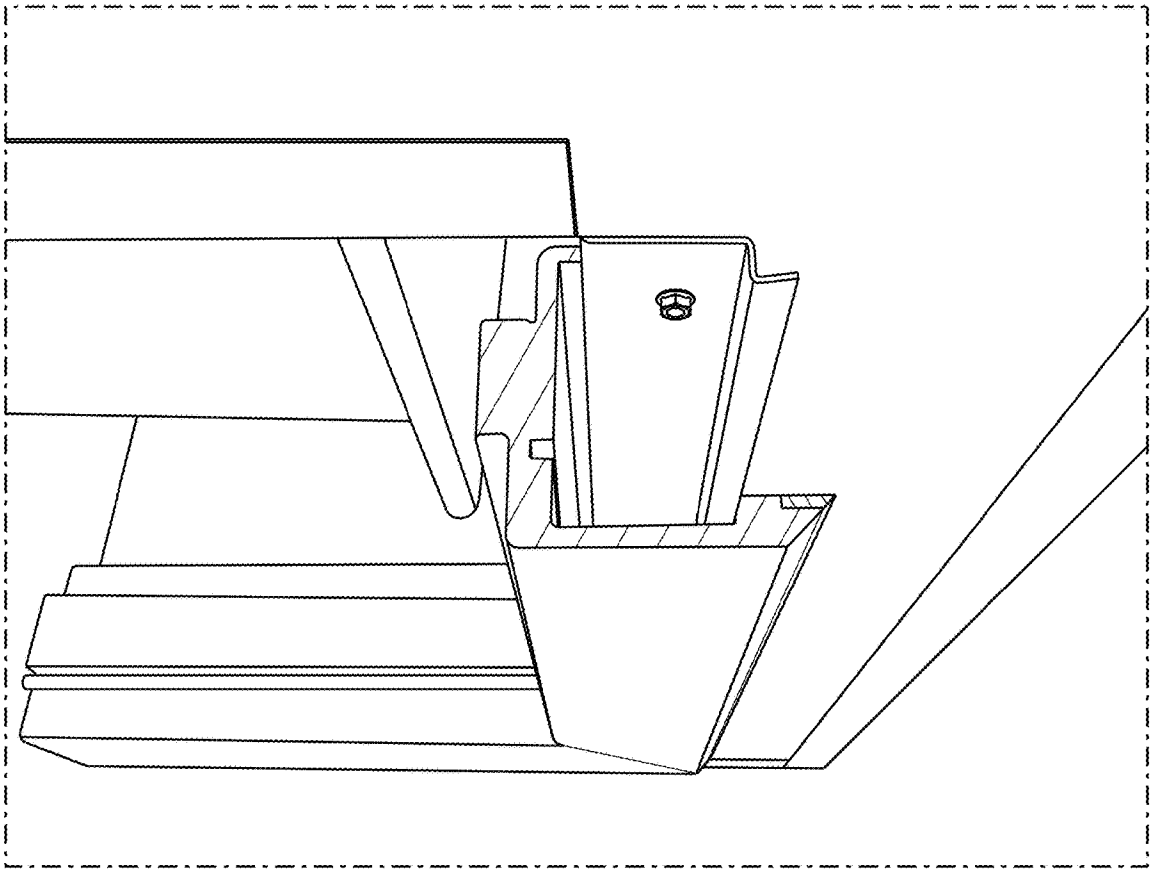
FIG. 5. Image of a partial door frame installed on a doorway opening (left/front view).
Figure 6:
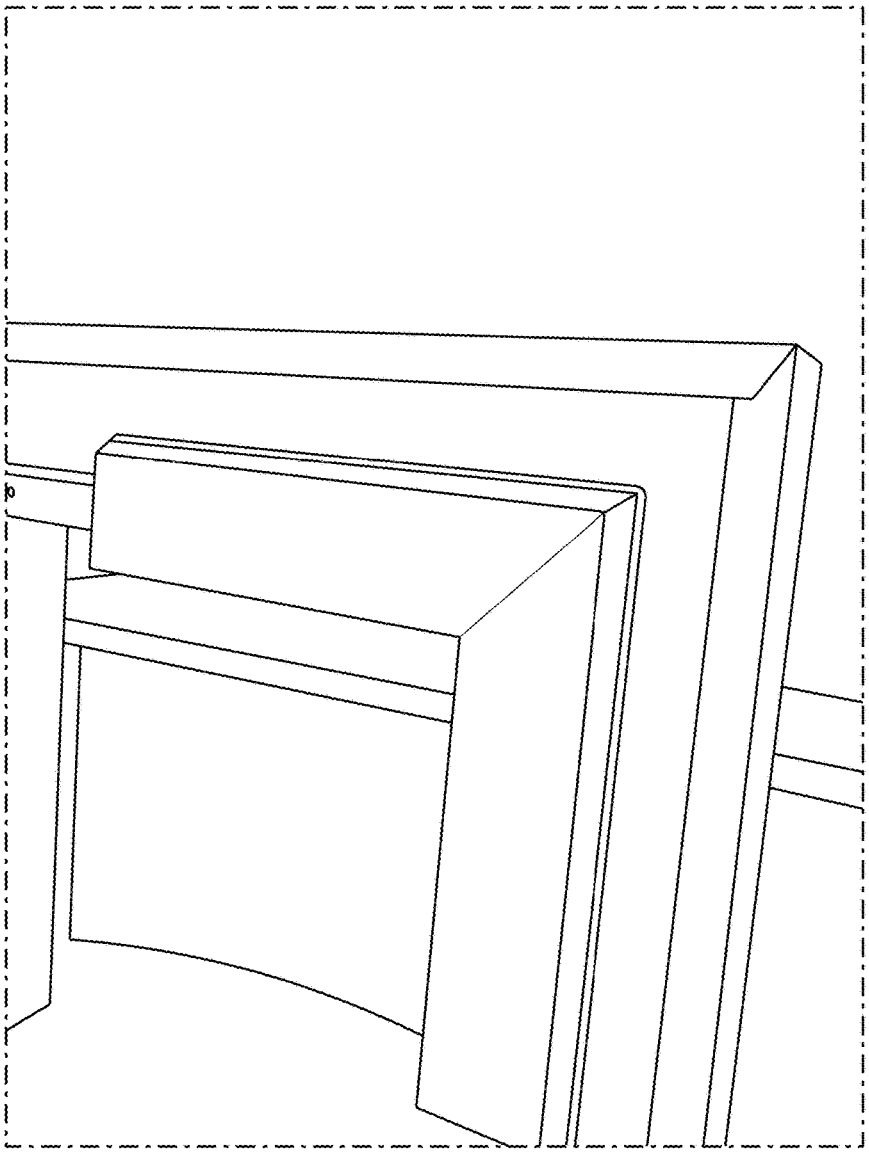
FIG. 6. Image of a partial door frame installed on a doorway opening (right/front view).

As used herein, the term "C-channel" refers to an elongated structural element with a cross-section having a web with two flanges at either end of the web, the flanges oriented orthogonally (or approximately or substantially orthogonally) to the web, and the flanges extending in only one direction from the web (FIG. 4A). The cross-section of a C-channel resembles the letter "C" and extends the length of the channel (allowing for teeth, notches, holes, and other attachment/fastening elements regularly or irregularly spaced along the length of the channel).

As used herein, the term "I-channel" refers to an elongated structural element with a cross-section having a web with two flanges at either end of the web, the flanges oriented orthogonally (or approximately or substantially orthogonally) to the web, and the flanges extending in both orthogonal directions from the web (FIG. 4B). The cross-section of a I-channel resembles the letter "I" and extends the length of the channel (allowing for teeth, notches, holes, and other attachment/fastening elements regularly or irregularly spaced along the length of the channel).

As used herein, the term "angle rail" refers to an elongated structural element with a cross-section having a web with a single flange at one end of the web, the flange oriented orthogonally (or approximately or substantially orthogonally) to the web, and the flange extending in only one orthogonal direction from the web (FIG. 4C). The cross-section of an angle rail resembles the letter "L" and extends the length of the rail (allowing for teeth, notches, holes, and other attachment/fastening elements regularly or irregularly spaced along the length of the channel).

DETAILED DESCRIPTION

Provided herein are door frames. In particular, door frames are provided that protect against impact, are waterproof, and protect against bacteria/mold infiltration.

Existing door frames present many issues that result in suboptimal performance (e.g., with regard to water resistance, microbial resistance, durability, etc.). For example, the ends of a conventional door frame facing away from the opening terminate in a squared-off ends; this conformation does not shed water properly during cleaning, especially for door frame pieces located at the top of the opening, and is susceptible to damage from collisions. Additionally, the openings/keys that receive sealant, when present in conventional door frames, are not properly shaped to hold sealant; this in turn leads to the door frame peeling away from the wall panel and allowing water to become trapped in the space between the door frame and the wall panel. This in turn can spread bacteria and disease, while over time causing damage to both the door frame and the wall panel. Furthermore, conventional door frames intended to improve the hygiene of an area often come loose due to the door frame's connection to the wall panel. The stress applied by opening and shutting the door, along with collisions caused by machinery and individuals leads to the door frame becoming distorted and damage. The damage leads to gaps forming between the door frame and the wall, which is source for bacteria and disease to grow. Other door frames are built during the construction of the wall panel, such that the door frame is integrated into the wall panel in a uniformed body design. However, this is problematic in that it requires foresight into the usage of the room or in other instances an entire building. Thus, in order to take advantage of such a door frame requires rebuilding the entire wall panel and door frame, which is both time consuming and expensive. Thus, it is a primary objective of the door frame systems described herein to provide a door frame that improves upon the art.

In some embodiments, a door frame comprises a U-shaped cross-section, uniformly along its length. In some embodiments, such a frame is placed over an end of the wall panel. In some embodiments, the frame is secured to the opening in the wall by one or more elongated structural elements (e.g., C-channel, angle rail, etc.) that are attached to the wall and comprise attachment/fastening elements (e.g., notches, teeth, etc.) for securing the frame to the wall.

In some embodiments, door frame systems are provided in which a brackets (e.g., C-channels, angle rails, etc.) are secured (e.g., by screws, by through bolt(s), etc.) to the wall surrounding a doorway opening (e.g., to the header, to the verticals). In some embodiments, brackets display attachment elements (e.g., notches, teeth, a rail, etc.) that facilitated attachment of the door frame components to the wall surrounding the door opening. In some embodiments, the door frame components are hung on the attachment elements of the brackets. In some embodiments, the door frame components engage with the attachment elements of the brackets.

In some embodiments, a door frame comprises two halves that mount onto a doorway from opposite sides of the wall (e.g., inside/outside). In some embodiments, each half of the door frame mounts onto the bracket(s) on the door opening. In some embodiments, the bracket(s) present attachment elements to both sides of the door opening and each half of the frame engages the bracket on its respective side. In some embodiments, the two halves of the frame contact one another (e.g., overlap) within the doorway. In some embodiments, the portions of the two halves that engage each other are non-identical. In some embodiments, the portions of the two halves that engage each other are configured to stably engage each other.

In some embodiments, a complete door frame comprises several pockets or openings at locations where the door frame meets another component (e.g., where two halves of the door frame meet, when the door frame meets the wall). In some embodiments, when installed on a wall, the ends of the door frame sit against the wall. In some embodiments, pockets or openings at the ends of the door frame (cross-sectional end) provides a location for an adhesive or sealant to be applied. In some embodiments, pockets or openings at the portion of one or both of the door frame halves provides a location for an adhesive or sealant to be applied (e.g., to seal the halves together). In some embodiments, keys are positioned (e.g., within a pocket or opening) to receive a sealant/adhesive to create a water-tight seal between the door frame and the wall panel. By creating a water-tight seal, the wall panel, the door, and the door frame can be sprayed down, which allows for the room in which the door frame is installed to be kept clean.

In some embodiments, an objective of the door frame systems herein is to provide a door frame that has multiple pieces that seamlessly seal to a wall panel. In some embodiments, an objective of the door frame systems herein is to provide a door frame that chemically seals to a wall panel. In some embodiments, an objective of the door frame systems herein is to provide a door frame that seamlessly connects via direct connection to a pre-existing wall panel. In some embodiments, an objective of the door frame systems herein is to provide a door frame configured to adapt to wall panels of varying size. In some embodiments, an objective of the door frame systems herein is to provide a door frame that provides superior reservoirs. In some embodiments, an objective of the door frame systems herein is to provide a door frame that is configured to enhance liquid runoff and hygienic conditions. These and other objectives, features, and advantages of the invention will become apparent from the specification and claims.

With general reference to the figures, an exemplary door frame system 10 is shown having a bracket or channel connected to a wall panel 14, and a multi-piece door frame 16 connected to the bracket or channel 12 and to the wall panel 14. The multi-piece door frame 16 is sealed with a sealant 18 in one or more openings 20 in the multi-piece door frame 16, such that the multi-piece door frame 16 is chemically welded to the wall panel 14 in a seamless configuration, which provides for ease of cleaning and the maintenance of a hygienic environment.

Figure 3:
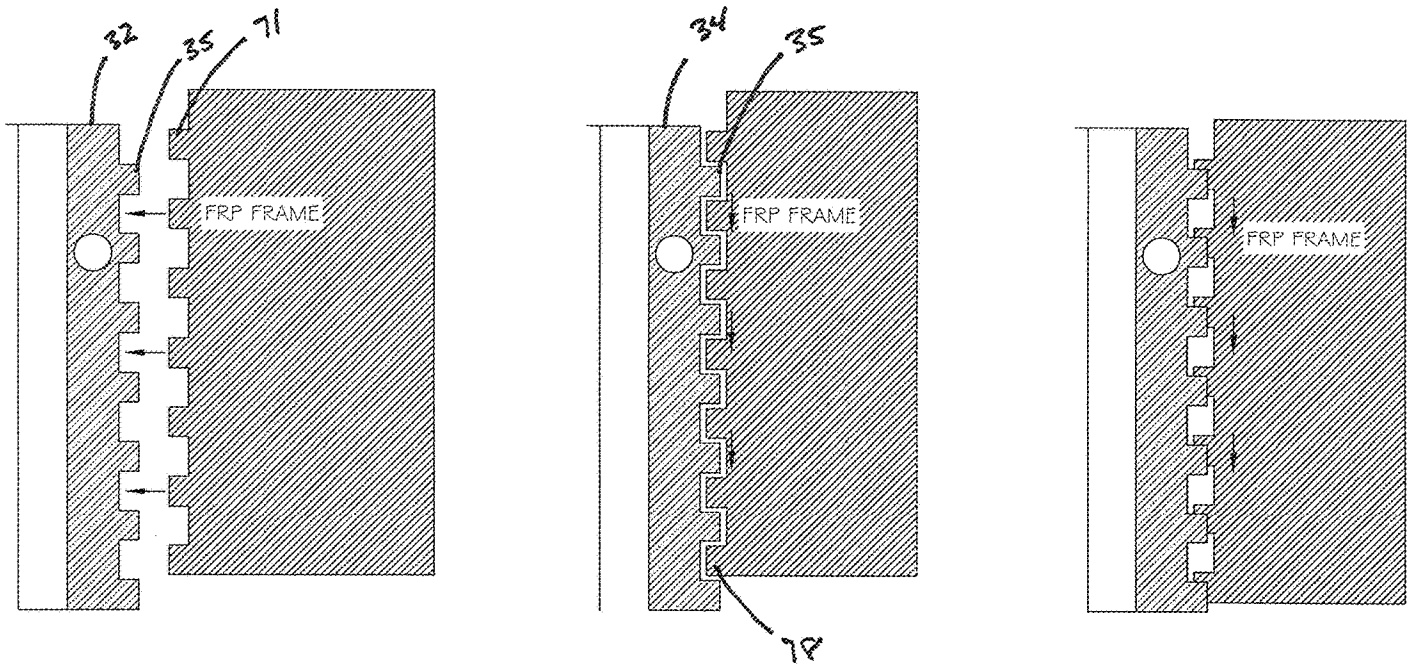
FIG. 3. Schematic demonstrating attachment of a door frame to a wall via engagement of notches on the frame with complementary notches on the bracket secured to the wall.

In some embodiments, the bracket 12 has a generally C-shaped design, such that the bracket 12 has an end wall 22 with a first sidewall 24 and a second sidewall 26 extend outwardly from the end wall 22. The first sidewall 24 and second sidewall 26 have indented portions 28 and 30 that indent towards one another. In this fashion, a first flange 32 is formed at the end of the first sidewall 24 by the first indented portion 28 and a second flange 34 is formed at the end of the second sidewall 26 by the second indented portion 30. As seen in FIG. 3, in some embodiments, at least one of the flanges 32 and 34 have a plurality of teeth 35 on at least one side.

The bracket (e.g., C-channel, angle rail, etc.) is made of any suitable material (e.g., metal, plastic, etc. In some embodiments, the bracket comprises steel or aluminum. In one embodiment, the bracket 12 is made of 14-gauge steel to ensure rigid and durable construction, but in other embodiments is made of any suitable material that maintains rigidity, durability, and a hygienic environment.

The wall panel 14, in one embodiment, is an insulated metal panel, but can be made of other suitable materials in various other embodiments. In some embodiments, a wall or wall panel comprises a polymer or polymer composite material (e.g., ultra-high-molecular-weight polyethylene (UHMW) or fiber reinforced plastic (FRP)).

The bracket 12 is connected to and engages an exterior surface 36 of the wall panel 14. In one embodiment, the end wall 22 of bracket 12 engages an end 38 of the wall panel, the first sidewall 24 of the bracket 12 engages a first side 40 of the wall panel 14, and the second sidewall 26 of the bracket 12 engages a second side 42 of the wall panel 16.

In the illustrative embodiment, the first indented portion 28 and the second indented portion 30 engage the exterior surface 36 of the wall panel 14. In this arrangement, a first opening 44 and a second opening 46 is formed in the space between the wall panel 14 and the bracket 12 between first indented portion 28 and the second indented portion 30 and the end wall 22. The first flange 32 and the second flange 34 are positioned a distance away from the wall panel 14.

One or more connection member 48 is received through the bracket 12 and the wall panel 14 to connect the bracket 12 to the wall panel 14. In one arrangement, the one or more connection member 48 is positioned between and through the first indented portion 28 and the second indented portion 30 so that the one or more connection member 48 does not extend beyond the first indented portion 28 and the second indented portion 30 once the connection member 48 is installed into the bracket 12 and wall panel 14. In one embodiment of the present invention, the one or more connection member 48 is a stainless steel tapped in screw. In alternative embodiments, the one or more connection member 48 can be a screw, bolt, or other suitable member for connection.

Received over the bracket 12 and a portion of the wall panel 14 is the multi-piece door frame 16, which receives and engages the first flange 32 and second flange 34 of the bracket 12. The multi-piece door frame 16 extends a length of the wall panel 14 upon installation, such as from a floor 50 to a top of a door opening 52. The multi-piece door frame 16 in one embodiment of the present invention is constructed of Fiberglass Reinforced Plastic (FRP).

The multi-piece door frame 16 is made of two or more pieces, and in the embodiment shown in the Figures is made of a first piece 54 and a second piece 56. In the arrangement shown, the first piece 54 and the second piece 56 have a generally L-shape, which when interlocked form a general U-shape. In this arrangement, the first piece 54 has a first portion 58 that terminates at a first end 60 and a corner 62 at the opposing end and a second portion 64 that terminates at a second end 66 and at the opposing end terminates at the corner 62.

In one embodiment, the first portion 58 has a first cavity 68 formed between the first piece 54 and the wall panel 14 that is configured to receive the bracket 12 as the size and shape of the cavity 68 is the same depth as the distance the bracket 12 extends outwardly from the wall panel 14. A first key 70 is positioned adjacent to the first cavity 68 and runs parallel to the first side 40 of the wall panel 14, such that during installation the first flange 32 of the bracket 12 is received within the first key 70. The first key 70, in one arrangement, has a plurality of teeth 71 that engage and interlock with the plurality of teeth 35 on the first flange 32.

In one arrangement of the present invention, the second portion 64 has a first slot or step 72 that extends from the second end 66 towards the corner 62 on the side of the first piece 54 facing the end 38 of the wall panel 14 during installation. The first slot 72 is configured to receive a portion of the second piece 56 as more fully described herein.

Extending from the corner 62 towards the second end 66 is a second slot or step 74. The second slot 74 extends on the side of the first piece 54 opposing the end of the wall panel 14 during installation and is also on the opposite side and end as the first slot 72.

The second slot 74 is sized and shaped to attach a door hinge 76 to the multi-piece doorframe 16, bracket 12, and wall panel 14 or a combination thereof to the hinged attachment of a door 78. In one embodiment, one or more openings 81 are pre-existing or pre-fabricated into the second portion 64 of the first piece 54 to facilitate the passage of one or more attachment members 80 through the first piece 54 and door hinge 76, which in one arrangement are screws 80.

In the side opposite where the door hinge 76 is attached, which runs perpendicular to the end 38 of the wall panel 14, is a groove or one or more apertures 82. A gasket 83, such as a silicone gasket, is inserted into the groove 82 to provide an air-tight or liquid-tight seal upon the closing of the door 78 due to the pressure applied by the door 78.

The second piece 56 also has a first portion 84 that terminates at a first end 86 and a corner 88 at the opposing end and a second portion 90 that terminates at a second end 92 and at the opposing end terminates at the corner 88. In one embodiment, the first portion 84 has a second cavity 94 formed between the second piece 56 and the wall panel 14 that is configured to receive the bracket 12 as the size and shape of the second cavity 94 is the same depth as the distance the bracket 12 extends outwardly from the wall panel 14. A second key 96 is positioned adjacent to the second cavity 94 and runs parallel to the second side 42 of the wall panel 14, such that during installation the second flange 34 of the bracket 12 is received within the second key 96. The second key 96, in one arrangement, has a plurality of teeth 98 that engage and interlock with the plurality of teeth 35 on the second flange 34.

The second portion 90 of the second piece 56 is sized and shaped to be received in the first slot 72 of the first piece 54. In at least one embodiment, second portion 90 of the second piece 56 is sized and shaped to fill the space between the bracket 12 and the second portion 64 of the first piece 54; however, a space 100 (not shown) may remain in the event that the end 38 of the wall panel 14 is too wide for the first piece 54 and the second piece 56 to fully interlock with one another.

One or more attachment member 80 is received through the overlapping portions of second portion 64 of the first piece 54 and the second portion 90 of the second piece 56 to attach the multi-piece door frame 16 together by mechanical means. In some arrangements, as shown, the one or more attachment members 80 also connect the multi-piece door frame 16 to the bracket 12 and the wall panel 14. The attachment member 80 is received in one or more pre-existing or pre-fabricated opening 81 in the multi-piece door frame 16.

In at least one embodiment, the first cavity 68 and the second cavity 94 is larger than the first sidewall 24 and second sidewall 26 of the bracket 12 to allow the multi piece door frame 16 to extend past the end wall 22 of the bracket 12, thereby forming a space 102 between the end wall 22 of the bracket 12 and the second portions 64, 90 and the first piece 54 and second piece 56.

In one arrangement, the first end 60 and second end 66 of the first piece 54, and the first end 86 of the second piece 56 each have an opening 20. In other arrangements, an opening 20 is positioned at only one or more of those positions. Each opening 20 is positioned on the interior side of the multi-piece door frame 16, such that during installation the opening 20 faces the exterior surface 36 of the wall panel 14. In some arrangements, at least one of the openings 20 has a key 104. The key 104 is positioned within the opening 20 and at a direction substantially perpendicular to the direction of the opening 20 and to the exterior surface 36 of the wall panel 14 the opening 20 is most closely positioned to. The openings 20 in some arrangements run the entire length of the multi-piece door frame 16 and in other arrangements only run a portion of the multi-piece door frame.

The sealant 18 is received within the one or more openings 20. In one embodiment, the sealant is KL25 disclosed in U.S. Ser. No. 14/609,117, Method of Filling and Sealing a Joint Between Panels, which is herein incorporated by reference. Any compositions, methods or reagents described in U.S. Ser. No. 14/609,117 are herein incorporated by reference. The sealant 18 in other embodiments is silicone or urethane caulk. The sealant 18 provides a chemical weld between the wall panel 14 and the multi-piece door frame 16 and a chemical weld between the first piece 54 and the second piece 56 of the multi-piece door frame 16.

From the opening 20 of the first ends 60 and 86 of the first piece 54 and the second piece 56 are slanted portions 103 that extend outwardly from the first side 40 and second side 42 and back towards the end 38 of the wall panel 14. In this manner, the slanted portions 106 permit the door frame system 10 to be sprayed with a cleaning liquid without the risk of pooling on the multi-piece door frame 16.

In operation, the bracket 12 is placed over the end 38 of a wall panel 14 and the connection member 48 is used to secure the bracket 12. Once the connection member 48 is received through the first indented portion 28 and second indented portion 30 of the bracket 12, the connection member 48 should at least be flush with the first sidewall 24 and second sidewall 26.

Next, the second piece 56 of the multi-piece door frame 16 is put into position such that the second sidewall 26 of the bracket 12 is placed within the second cavity 94 with the second flange 34 of the bracket 12 being received in the second key 96. The interlocking of the plurality of teeth 35 of the bracket 12 and the plurality of teeth 98 of the second piece 56 assists in holding the second piece 56 in place as well as the multi-piece door frame 16 overall in place once installation is complete. During positioning of the second piece 56, the second portion 90 will engage the end wall of the bracket 12.

Thereafter, the first piece 54 of the multi-piece door frame 16 is put into position such that the first sidewall 24 of the bracket 12 is placed within the first cavity 68 with the first flange 32 of the bracket 12 being received in the first key 70. The interlocking of the plurality of teeth 35 of the bracket 12 and the plurality of teeth 71 of the first piece 54 assists in holding the first piece 54 with the bracket as well as the overall multi-piece door frame 16 once installation has been finished.

During the positioning of the first piece 54, the second portion 64 of the first piece 54 will overlap at least a portion of the second portion 90 of the second piece 56. More particularly, the second portion 90 will be received in the first slot 72. The ability to install the multi-piece door frame 16 using multiple pieces permits the installation on wall panels 14 having varying sizes as well as permitting the installation of the multi-piece door frame to pre-existing wall panels 14.

One or more attachment members 80 are then used to attach the first piece 54 to the second piece 56, which pass through the overlapping portion of the two pieces. In some embodiments, the attachment members 80 also pass through the bracket 12 and the wall panel.

In some embodiments, a gasket 83 is inserted into the groove of the second slot 74. In other arrangements, the gasket 83 is installed during fabrication of the multi-piece door frame 16. A door hinge 76 and door 78 are then attached to the second slot 74 by one or more attachment members 80.

To finalize installation, the one or more openings 20 are filled with sealant 18. The sealant 18 chemically seals the multi-piece door frame 16 to the wall panel 14 and in some embodiments, the first piece 54 to the second piece 56. In this manner, the entirety of the multi-piece door frame 16 is chemically sealed, which provides a seamless multi-piece door frame 16.

The keys 104 within the openings 20 provide for a superior chemical weld between the wall panel 14 and multi-piece door frame 16. The keys 104 are positioned such that the sealant 18 cannot be easily pushed or pulled away; and, thus the receipt of the sealant 18 within the keys is advantageous in comparison to openings 20 alone.

During cleaning, the slanted portions 106 along the outside perimeter of the door frame system 10 prevents liquid from pooling and encourages runoff. As such, any waste materials are prevented from collecting and instead run down the liquid-tight and air-tight door frame system, thereby maintain a superior hygienic environment.

Therefore, a door frame system 10 has been provided that provides a door frame that chemically seals to a wall panel, that seamlessly connects via direct connection to a pre-existing wall panel, is configured to adapt to wall panels of varying size, provides a door frame that provides superior openings for sealants, is configured to enhance liquid runoff and hygienic conditions, and improves upon the art.

In some embodiments, door frame systems (e.g., wall panel(s), brackets, frame components, sealing reagents, etc.) are provided that are composed of (or for use with) damage resistant materials (e.g., impact resistant, abrasion resistant, low coefficient of friction, etc.), such as a polymer, metal, alloy, combinations thereof, etc.

In some embodiments, one or more elements of the door frame systems described herein systems (e.g., wall panel(s), brackets, frame components, etc.) comprise and/or are manufactured from a composite material, such as, a polymer matrix (e.g., vinylester, polyester, etc.), epoxy, phenol formaldehyde, polyester thermosetting plastic (e.g., PEEK, PEKK, PPS), etc., reinforced with fibers, such as carbon, aramid, glass, Kevlar, boron, basalt, Hybor, quartz, asbestos, etc. In some embodiments, the composite materials comprise additional components, such as, metal, metal foil (e.g., TiGr), or fiber metal laminate. In some embodiments, the composite materials are generally are "cured" into a stronger form through an endothermic chemical reaction, which requires the addition of energy, for example, by way of heating or irradiation. Examples of composite materials used in various embodiments of this herein include graphite fiber reinforced epoxy, fiber reinforced plastic (FRP), glass-fiber reinforced plastic (GRP), carbon-fiber reinforced plastic (CRP), metal matrix composites (MMC), and reinforced carbon-carbon (carbon fiber in a graphite matrix).

In some embodiments, one or more elements of the door frame systems described herein systems (e.g., wall panel(s), brackets, frame components, sealing reagents, etc.) comprise and/or are manufactured from a fiber reinforced plastic (FRP). FRPs are a category of composite plastics that use elongated fibrous materials to alter and/or enhance characteristics of the plastic, such as mechanical characteristics (e.g., strength, elasticity, rigidity, etc.). FRP manufacturing typically involves two distinct processes: (1) the fibrous material is manufactured and formed, and (2) the fibrous material is bonded with the polymer matrix during molding. The fibers may be manufactured in two- or three-dimensional orientations (e.g., aligned along a plane x- and y-directions, fibers incorporated in the x-, y- and z-directions). Fiber preforms may be manufactured in sheets, continuous mats, or as continuous filaments for spray applications. The four major ways to manufacture the fiber preform is through the textile processing techniques of weaving, knitting, braiding and stitching. A rigid structure is usually used to establish the shape of FRP components. In some embodiments, parts are laid up on a flat surface referred to as a "caul plate" or on a cylindrical structure referred to as a "mandrel." However, most fiber-reinforced plastic parts are created with a mold or "tool." In some embodiments, the molding process of FRP begins by placing a fiber preform on or in a mold. The fiber preform may be dry fiber, or fiber that already contains a measured amount of resin ("prepreg"). Dry fibers are "wetted" with resin either by hand or the resin is injected into a closed mold. The part is then cured, leaving the matrix and fibers in the shape created by the mold. Heat and/or pressure are sometimes used to cure the resin and improve the quality of the final part. Different methods of forming include bladder molding, compression molding, autoclave and vacuum bag, mandrel wrapping, chopper gun, filament winding, pultrusion, and resin transfer molding. In some embodiments, any suitable materials sand methods for the production of one or more elements of the door frame systems described herein systems (e.g., wall panel(s), brackets, frame components, sealing reagents, etc.) out of FRP materials find use in embodiments herein.

In some embodiments, one or more elements of the door frame systems described herein systems (e.g., wall panel(s), brackets, frame components, sealing reagents, etc.) comprise and/or are manufactured from a polymer material. Some non-limiting examples of suitable nondegradable materials include polymeric materials, for example, polyolefins such as polyethylene (e.g., ultra-high molecular weight polyethylene (UHMWPE or UHMW)) and polypropylene including atactic, isotactic, syndiotactic, and blends thereof; polyethylene glycols; polyethylene glycol (PEG) coated polyethylene terephthalate (PET), polyethylene oxides; polyisobutylene and ethylene-alpha olefin copolymers; fluorinated polyolefins such as fluoroethylenes, fluoropropylenes, fluoroPEGSs, and polytetrafluoroethylene; polyamides such as nylon, Nylon 6, Nylon 6,6, Nylon 6,10, Nylon 11, Nylon 12, and polycaprolactam; polyimines; polyesters such as polyethylene terephthalate, polyethylene naphthalate, polytrimethylene terephthalate, and polybutylene terephthalate; polyethers; polybutester; polytetramethylene ether glycol; 1,4-butanediol; polyurethanes; acrylic polymers; methacrylics; vinyl halide polymers such as polyvinyl chloride; polyvinyl alcohols; polyvinyl ethers such as polyvinyl methyl ether; polyvinylidene halides such as polyvinylidene fluoride and polyvinylidene chloride; polychlorofluoroethylene; polyacrylonitrile; polyaryletherketones; polyvinyl ketones; polyvinyl aromatics such as polystyrene; polyvinyl esters such as polyvinyl acetate; etheylene-methyl methacrylate copolymers; acrylonitrile-styrene copolymers; ABS resins; ethylene-vinyl acetate copolymers; alkyd resins; polycarbonates; polyoxymethylenes; polyphosphazine; epoxy resins; aramids; rayon; rayon-triacetate; spandex; silicones; and copolymers and combinations thereof.

In some embodiments, one or more elements of the door frame systems described systems (e.g., wall panel(s), brackets, frame components, sealing reagents, etc.) comprise and/or are manufactured from ultra-high-molecular-weight polyethylene (UHMW), or high-modulus polyethylene as is it also known, which is a subset of thermoplastic polyethylene. UHMW is well-known in the art of plastics by having high impact strength and abrasion resistance (Stein, H. L., *Ultra High Molecular Weight Polyethylene*, Engineered Material Handbook, Vol. 2, 167-171 (1998); herein incorporated by reference in its entirety). UHMW is 15 times more resistant to abrasion than carbon steel and its coefficient of friction is significantly lower than that of nylon and acetyl. UHMW has superior abrasion resistance than Teflon. The combination of high impact strength, coefficient of friction, and abrasion resistance of UHMW makes well-suited for applications where lower molecular weight grades fail. UHMW has been used in medical devices, cables, wire, and fibers for personal armor, cut-resistant gloves, bow strings, fishing line, climbing gear, and industrial webbing. UHMW is both FDA and USDA approved for use in food processing and medical applications. UHMW cannot be transformed and molded by conventional plastic processing techniques such as injection molding, blow molding or thermoforming. Rod tubing and profiles of UHMW are typically created by compression molding or ram extrusion processing. During ram extrusion, UHMW powder is gravity fed into a chamber and a hydraulic ram pushes the powder from this chamber into a die. The die is the shape of the desired plastic, a certain diameter rod, a certain tube, or a profile shape. Heaters are employed on the outside of the die to heat the plastic and make it form into the shape of the die. The hydraulic ram moves back and forth continuously feeding the powder into the die. As the material comes out of the die, it travels the length of the conveyor after which it is cut to length. Ram extrusion does not shear the material that is being manufactured as does single screw extrusion which employs a rotating screw to move the material. It moves the material by hydraulically pushing it through the die which is the desired shape of the end product.

In some embodiments, door frame components herein are shaped/formed by any suitable technique, such as ram extrusion, compression molding, gel spinning, sintering, 3D printing, etc.

In some embodiments, adhesives, glues, and/or sealants are provided in the systems herein to adhere two or more components together (e.g., frame to frame, frame to wall, etc.). In some embodiments, adhesives, glues, and/or sealants are provided in the systems herein to seal a gap between to components. Exemplary adhesives, glues, and/or sealants that find use in some embodiments herein include, but are not limited to: epoxies, silicone-based, cyanoacrylates, urethanes adhesives, acrylic adhesives, rubber cements, pressure sensitive adhesives, heat sensitive adhesives, thermosetting structural adhesives, UV-curing adhesives, acrylic, foam, latex sealants, polysulfide sealants, polyurethane sealants, etc. In some embodiments, the type of adhesives, glues, and/or sealants is selected based on the materials to be adhered/sealed and/or the desired characteristics of the adhesion/seal (e.g., strength, durability, lifetime, waterproof, bacteria/mold resistance, etc.).

In some embodiments, a chemical weld is provided in the systems herein to adhere two or more components together (e.g., frame to wall, frame to frame, etc.). Compared to glues and sealants, a chemical weld is a more permanent method for bonding two materials. Chemical welding involves the application of one or more materials (e.g., solvents, reactants, components, etc.) on a surface or between two surfaces; a chemical reaction within the applied materials and/or between the applied materials and the surfaces results in chemical bonding of the surfaces (e.g., to each other, to the weld materials, etc.). Exemplary chemical components of chemical weld systems that may find use in embodiments herein include, but are not limited to: an aromatic polyisocyanate such as 1,3-phenylenediisocyanate, 4,4'-diphenyldiisocyanate, 1,4-phenylenediisocyanate, 4,4'-diphenylmethanediisocyanate, 2,4-tolylenediisocyanate, 2,6-tolylenediisocyanate, 4,4'-toluidinediisocyanate, 2,4,6-triisocyanatetoluene, 1,3,5-triisocyanatebenzene, dianisidine diisocyanate, 4,4'-diphenyletherdiisocyanate, 4,4',4"-triphenylmethanetriisocyanate or xylene diisocyanate; an aromatic polyisocyanate such as tri-methylene diisocyanate, tetra-methylene diisocyanate, hexa-methylene diisocyanate, penta-methylene diisocyanate 1,2-propylenediisocyanate, 2,3-butylenediisocyanate, 1,3-butalenediisocyanate, dodeca-methylene diisocyanate or 2,4,4-trimethylhexamethylenediisocyanate; an aliphatic polyisocyanate such as omega,omega-diisocyanate-1,3-dimethylbenzene, omega,omega-diisocyanate-1,4-dimethylbenzene, omega, omega-diisocyanate-1,4-diethylbenzene, 1,4-tetramethylxylylenediisocyanate, 1,3-tetramethylxylenediisocyanate; an alicyclic polyisocyanate such as 3-isocyanatemethyl-3,5,5-trimethylcyclohexylisocyanate, 1,3-cyclopentanediisocyanate, 1,3-cyclohexanediisocyanate, cyclohexanediisocyanate, methyl-2,4-cyclohexanediisocyanate, methyl-2,6-cyclohexanediisocyanate, 4,4'-methylenebis (cyclohexylisocyanate) or 1,4-bis(isocyanatomethyl) cyclohexane; an aromatic dicarboxylic acid such as sigma-phthalic acid, isophthalic acid, terephthalic acid, 1,4-dimethylterephthalic acid, 1,3-dimethylisophthalic acid, 5-sulfo-1,3-dimethylisophthalic acid, 4,4-bidphenyldicarboxylic acid, 1,4-naphthalenedicarboxylic acid, 2,6-naphthalenedicarboxylic acid, norbornene dicarboxylic acid, diphenylmethane-4,4'-dicarboxylic acid or phenylindandicarboxylic acid; an aromatic dicarboxylic acid anhydride such as phthalic anhydride, 1,8-naphthalenedicarboxylic acid anhydride or 2,3-naphthalenedicarboxylic acid anhydride; an alicyclic dicarboxylic acid such as hexahydrophthalic acid; an alicyclic dicarboxylic acid anhydride such as hexahydrophthalic anhydride, 3-methyl-hexahydrophthalic anhydride, 4-methyl-hexahydrophthalic anhydride or 1,2-cyclohexanedicarboxylic acid anhydride; an aliphatic dicarboxylic acid such as oxalic acid, malonic acid, succinic acid, adipic acid, sebacic acid, azelaic acid, suberic acid, maleic acid, chloromaleic acid, fumaric acid, dodecanoic acid, pimellic acid, citraconic acid, glutaric acid or itaconic acid; an epoxy group such as ethyleneglycoldiglycidylether, triglycidylether, trimethylolpropanetriglycidylether, N,N,N',N'-tetraglycidylethylenediamine, or glycerin diglycidylether; an acid anhydride group such as pyromellitic anhydride, benzophenonetetracarboxylic acid dianhydride, biphenyltetracarboxylic acid dianhydride, oxydiphthalic acid dianhydride, diphenyl sulfone tetracarboxylic acid dianhydride, diphenyl sulfide tetracarboxylic acid dianhydride, butanetetracarboxylic acid dianhydride, perylene tetracarboxylic acid dianhydride, or naphthalenetetracarboxylic acid dianhydride; an aziridinyl group such as N,N'-toluene-2,4-bis(1-aziridinecarboxide), N,N'-diphenylmethane-4,4'-bis(1-aziridinecarboxide), triethylenemelamine, or tri-1-aziridinylphosphineoxide; an aliphatic diamine such as ethylenediamine or hexamethylenediamine; an alicyclic diamine such as 4,4'-diamino-3,3'-dimethyldicyclohexylmethane, 4,4'-diamino-3,3'-dimethyldicyclohexyl, diaminocyclohexane or isophoronediamine; or an aromatic diamine such as xylenediamine. Chemical welding agents that find use in embodiments herein may be others known in the field. Exemplary chemical weld systems are described, for example, in U.S. Pub No. 2016/0222263; U.S. Pub No. 2002/0114914, and U.S. Pat. No. 5,810,956; each of which is herein incorporated by reference in its entirety.

In some embodiments, one or more components of the door frame systems herein comprise or exhibit antimicrobial (e.g., anti-mold, antibacterial) and/or antiseptic characteristics. In some embodiments, one or more materials of the door frame systems herein comprise, are coated in, and/or are impregnated with an antimicrobial (e.g., anti-mold, antibacterial) and/or antiseptic agent. Suitable agents for rendering such materials antimicrobial (e.g., anti-mold, antibacterial) and/or antiseptic are understood in the field.

In some embodiments, one or more components of the door frame systems herein comprise or exhibit waterproof and/or water resistant characteristics. In some embodiments, one or more materials of the door frame systems herein comprise, are coated in, and/or are impregnated with a waterproof and/or water resistance agent. Suitable agents for rendering such materials waterproof and/or water resistant are understood in the field.

In some embodiments, the door frames and systems described herein find use in a variety of fields and facilities, including, but not limited to the meat processing industry, the fruit and vegetable industry, catering facilities, slaughter houses, the confectionary industry, retail shops, the fish processing industry, supermarkets, restaurants, the bakery industry, walk-in freezers, pharmaceutical manufacturing facilities, the dairy industry, logistics, hospitals, the beverage industry, etc.

In some embodiments, the frames described herein are not limited to doorway openings, but are also applicable to other openings in walls or wall panels. For example, an opening requiring a bottom frame element in addition to the side and top elements of a doorway, may be framed using the systems described herein. Such openings could include windows, pass-throughs, counters, etc. In some embodiments, a bottom of the frame comprises a bottom frame element that is similar to the top frame element, and is hung on a C-channel comprising a flange. Based on the disclosure herein, frame systems for any opening in a wall are within the scope of the present invention.

Any publications or patents mentioned in the present application are herein incorporated by reference. Various modification and variation of the described methods, compositions, and systems described herein will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention that are obvious to those skilled in the relevant fields are intended to be within the scope of the following claims.

The invention claimed is:

1. A door frame system comprising:

(a) a top C-channel configured for secure attachment to a header over a doorway opening, the doorway having a first face and a second face, wherein when securely attached to the header the top C-channel presents an first-face top flange along the top of the first face of the doorway and an second-face top flange along the top of the second face of the doorway;

(b) a pair of vertical C-channels configured for secure attachment to the wall ends on either side of the doorway opening, wherein when securely attached to the wall ends each vertical C-channel present a first-face vertical flange along a side of the first face of the doorway an second-face vertical flange along a side of the second face of the doorway, wherein the vertical flanges all comprise a series of gaps and flange teeth;

(c) a first-face door frame piece configured for covering the perimeter of the first face of the doorway, comprising a top frame element, a first-side frame element, and a second-side frame element, wherein:

(i) the top frame element comprises: (A) a first end configured for positioning at the top-most point of the door frame, the first end comprising: (1) a terminal opening and key configured to receive a sealant to affix the top frame element to a wall above the doorway, and (2) a hanger element configured to engage the first-face top flange and secure the top frame element above the doorway; (B) a second end configured for positioning against the underside of the doorway header and extending beyond a midpoint of the thickness from the first face to the second face of the underside of the header; and (ii) the first-side and second-side frame elements comprise: (A) first ends configured for positioning at the outer-most points of the first face of the door frame, the first ends comprising: (1) a terminal opening and key configured to receive a sealant to affix the side frame elements to walls on either side of the doorway, and (2) engagement elements comprising a series of gaps and frame teeth configured to engage the gaps and flange teeth of the first-face of the vertical C-channels and to secure the first-side and second-side frame elements of the first-face door frame piece against the first side and second side of the first face of the doorway; (B) second ends configured for positioning against the inside of the doorway sides and extending beyond midpoints of the thickness from the first face to the second face of the inside of the doorway sides; and (d) a second-face door frame piece configured for covering the perimeter of the second face of the doorway, comprising a top frame element, a first-side frame element, and a second-side frame element, wherein:

(i) the top frame element comprises: (A) a first end configured for positioning at the top-most point of the door frame, the first end comprising: (1) a terminal opening and key configured to receive a sealant to affix the top frame element to a wall above the doorway, and (2) a hanger element configured to engage the second-face top flange and secure the top frame element above the doorway; (B) a second end configured for positioning against the underside of the doorway header, extending beyond the midpoint of the thickness from the first face to the second face of the underside of the header, and covering a terminal portion of the second end of the top frame element of the first-face door frame piece; wherein the second end comprises a terminal opening and key configured to receive a sealant to affix the top frame element of the second-face door frame piece to the top frame element of the first-face door frame piece; and (ii) the first-side and second-side frame elements comprise: (A) first ends configured for positioning at the outer-most points of the second face of the door frame, the first ends comprising: (1) a terminal opening and key configured to receive a sealant to affix the side frame elements to walls on either side of the first face of the doorway, and (2) engagement elements comprising a series of gaps and frame teeth configured to engage the gaps and flange teeth of the second-face of the vertical C-channels and to secure the first-side and second-side frame elements of the second-face door frame piece against the first side and second side of the second face of the doorway; (B) second ends configured for positioning against the inside of the doorway sides, extending beyond the midpoints of the thickness from the first face to the second face inside of the doorway sides, and covering the terminal portion of the second end of the side frame elements of the first-face door frame piece; wherein the second end comprises a terminal opening and key configured to receive a sealant to affix the side frame elements of the second-face door frame piece to the side frame elements of the first-face door frame piece.

2. The door frame system of claim 1, wherein the C-channels comprise a metal material.

3. The door frame system of claim 2, wherein the C-channels comprise steal or aluminum.

4. The door frame system of claim 1, wherein the door frame pieces comprise a polymer or polymer composite material.

5. The door frame system of claim 4, wherein the door frame pieces comprise ultra-high-molecular-weight polyethylene (UHMW) or fiber reinforced plastic (FRP)).

6. The door frame system of claim 1, further comprising a wall panel comprising the doorway opening.

7. The door frame system of claim 6, wherein the wall panel comprises a polymer or polymer composite material.

8. The door frame system of claim 7, wherein the wall panel comprises ultra-high-molecular-weight polyethylene (UHMW) or fiber reinforced plastic (FRP)).

9. The door frame system of claim 1, further comprising sealant to affix the frame elements to the wall and to each other.

10. The door frame system of claim 9, wherein the sealant produces a chemical weld between the frame elements and the wall and/or between the frame elements and each other.

11. The door frame system of claim 1, wherein the C-channels further comprise indented portions for receiving one or more screws or bolts for securely attaching the C-channels to the doorway header and wall ends.

12. The door frame system of claim 1, wherein the first ends of the frame elements taper toward the wall when secured in place.

13. The door frame system of claim 1, wherein one or both of the side frame elements of the second-face door frame piece comprises a slot for attachment of a door hinge.

14. The door frame system of claim 13, further comprising a door hinge attached to the slot.

15. The door frame system of claim 14, further comprising door attached to the door hinge.

* * * * *